US011293641B2

(12) United States Patent
Purcell et al.

(10) Patent No.: US 11,293,641 B2
(45) Date of Patent: Apr. 5, 2022

(54) OBJECT WITH TEAR-SHAPED SUSPENSION FOR ANNULAR BODIES

(71) Applicant: General Electric Company, Schenectady, NY (US)

(72) Inventors: Timothy James Purcell, Centerville, OH (US); Heath Michael Ostebee, Easley, SC (US); Lucas John Stoia, Taylors, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/074,933

(22) Filed: Oct. 20, 2020

(65) Prior Publication Data

US 2021/0033284 A1 Feb. 4, 2021

Related U.S. Application Data

(63) Continuation-in-part of application No. 15/434,386, filed on Feb. 16, 2017, now abandoned.

(51) Int. Cl.
*F23R 3/28* (2006.01)
*F23D 11/38* (2006.01)

(52) U.S. Cl.
CPC ..... *F23R 3/283* (2013.01); *F23D 11/38* (2013.01); *F23R 2900/00018* (2013.01)

(58) Field of Classification Search
CPC .... F23R 3/28; F23R 3/283; F23R 3/60; F23R 2900/00018; F23D 11/38
See application file for complete search history.

(56) References Cited

U.S. PATENT DOCUMENTS 3,785,407 A 1/1974 Waite et al.
4,798,330 A 1/1989 Mancini et al.
(Continued)

FOREIGN PATENT DOCUMENTS

EP 2963347 A1 1/2016
WO 2015053940 A1 4/2015
(Continued)

OTHER PUBLICATIONS

Relates U.S. Appl. No. 15/434,386, Non-Final Office Action dated Feb. 26, 2019, 18 pages.
(Continued)

*Primary Examiner* — Ehud Gartenberg
*Assistant Examiner* — Henry Ng
(74) *Attorney, Agent, or Firm* — James Pemrick; Hoffman Warnick LLC

(57) ABSTRACT

An object includes an annular outer body having an end and an interior surface; a first annular inner body disposed inside the annular outer body, the first annular inner body having an exterior surface defining a first annular passage with the interior surface of the annular outer body. The first annular passage includes a first plurality of outlets formed on the end of the annular outer body, the first annular passage receiving a coolant and discharging the coolant adjacent the end of the annular outer body. The object also includes a second annular inner body disposed inside the first annular inner body, the second annular inner body defining a second annular passage with the first annular inner body. Further, the object includes a third annular inner body disposed inside the second annular inner body, with the third annular inner body defining a third annular passage with the second annular inner body; and a fourth annular passage opposite and surrounded by the third annular passage. The object
(Continued)

further includes a plurality of suspension elements connecting the interior surface of the annular outer body to the exterior surface of the first annular inner body, each suspension element including a first end connected to a first position on the first inner annular body and a second end connected to a second position on the annular outer body, wherein each first position is angularly circumferentially offset from each second position; and each suspension element is configured to substantially rigidly locate a position of the annular outer body relative to the first annular inner body in axial and lateral directions while permitting controlled deflection in a radial direction wherein the first position of each suspension element is angularly circumferentially offset to provide an imbalanced suspension capable of addressing an imbalanced loading, wherein each suspension element has an at least partially tear-shaped cross-section, and each of the second annular passage, the third annular passage, and the fourth annular passage includes a plurality of outlets formed through the annular outer body, adjacent the end, each of the plurality of outlets for each of the second annular passage, the third annular passage, and the fourth annular passage delivering a gas or fuel adjacent the end of the annular outer body.

17 Claims, 8 Drawing Sheets

(56) References Cited

U.S. PATENT DOCUMENTS

| | | | |
|---|---|---|---|
| 5,400,828 | A | 3/1995 | Ziu et al. |
| 5,595,703 | A | 1/1997 | Swaelens et al. |
| 6,715,292 | B1 | 4/2004 | Hoke |
| 2009/0255264 | A1 | 10/2009 | McMasters et al. |
| 2011/0247590 | A1 | 10/2011 | Donovan |
| 2014/0338338 | A1 | 11/2014 | Chila et al. |
| 2015/0000299 | A1 | 1/2015 | Zuo et al. |
| 2016/0003556 | A1 | 1/2016 | Ott et al. |
| 2016/0177834 | A1 | 6/2016 | Patel et al. |
| 2016/0209038 | A1 | 7/2016 | Kopp-Vaughan et al. |
| 2016/0236271 | A1 | 8/2016 | Xu |
| 2016/0245710 | A1 | 8/2016 | Twelves, Jr. et al. |

FOREIGN PATENT DOCUMENTS

| | | | |
|---|---|---|---|
| WO | 2015112385 | A1 | 7/2015 |
| WO | 2015147935 | A1 | 10/2015 |

OTHER PUBLICATIONS

Relates U.S. Appl. No. 15/434,386, Final Office Action dated Sep. 4, 2019, 19 pages.

Relates U.S. Appl. No. 15/434,386, Non-Final Office Action dated Mar. 31, 2020, 21 pages.

Relates U.S. Appl. No. 15/434,386, Final Office Action dated Jul. 20, 2020, 26 pages.

OBJECT WITH TEAR-SHAPED SUSPENSION FOR ANNULAR BODIES

This application is a continuation application of U.S. Ser. No. 15/434,386 filed Feb. 16, 2017, the entire contents of which are incorporated herein

BACKGROUND OF THE INVENTION disclosure relates generally to manufacturing annular bodies, and more particularly, to an object with a tear-shaped suspension for annular bodies such as those used in fuel nozzles.

Annular bodies are used in a wide variety of industrial settings in which the bodies must be positioned relative to one another and withstand a range of environmental changes. One application in which such structures are employed are fuel nozzles such as those employed on gas turbines. In this setting, a number of generally concentric annular bodies create passages therebetween to deliver combustion materials such as fuel(s) and/or air to a combustion chamber. In order for the fuel nozzle to remain thermally compliant, i.e., maintain positioning, physical integrity, etc., an annular outer heat shield is oftentimes formed about the outermost annular body of the fuel nozzle. Typically, the fuel nozzle annular bodies are configured to be stiff axially relative to a centerline thereof, but radially pliant.

BRIEF DESCRIPTION OF THE INVENTION

A first aspect of the disclosure provides an object including an annular outer body having an end and an interior surface; a first annular inner body disposed inside the annular outer body, the first annular inner body having an exterior surface defining a first annular passage with the interior surface of the annular outer body. The first annular passage includes a first plurality of outlets formed on the end of the annular outer body, the first annular passage receiving a coolant and discharging the coolant adjacent the end of the annular outer body. The object also includes a second annular inner body disposed inside the first annular inner body, the second annular inner body defining a second annular passage with the first annular inner body. Further, the object includes a third annular inner body disposed inside the second annular inner body, with the third annular inner body defining a third annular passage with the second annular inner body; and a fourth annular passage opposite and surrounded by the third annular passage. The object further includes a plurality of suspension elements connecting the interior surface of the annular outer body to the exterior surface of the first annular inner body, each suspension element including a first end connected to a first position on the first inner annular body and a second end connected to a second position on the annular outer body, wherein each first position is angularly circumferentially offset from each second position; and each suspension element is configured to substantially rigidly locate a position of the annular outer body relative to the first annular inner body in axial and lateral directions while permitting controlled deflection in a radial direction wherein the first position of each suspension element is angularly circumferentially offset to provide an imbalanced suspension capable of addressing an imbalanced loading, wherein each suspension element has an at least partially tear-shaped cross-section, and each of the second annular passage, the third annular passage, and the fourth annular passage includes a plurality of outlets formed through the annular outer body, adjacent the end, each of the plurality of outlets for each of the second annular passage, the third annular passage, and the fourth annular passage delivering a gas or fuel adjacent the end of the annular outer body.

A second aspect of the disclosure provides a fuel nozzle including, an annular outer heat shield having an end and an interior surface; a first annular inner body disposed inside the annular outer heat shield, the first annular inner body having an interior for delivering a combustion material and an exterior surface defining a first annular passage with the interior surface of the outer heat shield, wherein the first annular passage includes a first plurality of outlets formed on the end of the annular outer heat shield, the first annular passage receiving a coolant and discharging the coolant adjacent the end of the annular outer heat shield; a second annular inner body disposed inside the first annular inner body, the second annular inner body defining a second annular passage with the first annular inner body; a third annular inner body disposed inside the second annular inner body, the third annular inner body defining: a third annular passage with the second annular inner body; and a fourth annular passage opposite and surrounded by the third annular passage; and a plurality of suspension elements connecting the interior surface of the outer heat shield to the exterior surface of the first annular inner body, each suspension element including a first end connected to a first position on the first inner annular body and a second end connected to a second position on the annular outer body, wherein each first position is angularly circumferentially offset from each second position; and each suspension element is configured to substantially rigidly locate a position of the outer heat shield relative to the first annular inner body in axial and lateral directions while permitting controlled deflection in a radial direction, wherein the first position of each suspension element is angularly circumferentially offset to provide an imbalanced suspension capable of addressing an imbalanced loading; wherein each suspension element has an at least partially tear-shaped cross-section, and wherein each of the second annular passage, the third annular passage, and the fourth annular passage includes a plurality of outlets formed through the annular outer heat shield, adjacent the end, each of the plurality of outlets for each of the second annular passage, the third annular passage, and the fourth annular passage delivering a gas or fuel adjacent the end of the annular outer heat shield.

A third aspect of the disclosure provides a non-transitory computer readable storage medium storing code representative of an object, the object physically generated upon execution of the code by a computerized additive manufacturing system, code representing the object, the object including an annular outer body having an end and an interior surface; a first annular inner body disposed inside the annular outer body, the first annular inner body having an exterior surface defining a first annular passage with the interior surface of the annular outer body, wherein the first annular passage includes a first plurality of outlets formed on the end of the annular outer body, the first annular passage receiving a coolant and discharging the coolant adjacent the end of the annular outer body; a second annular inner body disposed inside the first annular inner body, the second annular inner body defining a second annular passage with the first annular inner body; a third annular inner body disposed inside the second annular inner body, the third annular inner body defining: a third annular passage with the second annular inner body; and a fourth annular passage opposite and surrounded by the third annular passage; and a plurality of suspension elements connecting the interior surface of the annular outer body to the exterior surface of the first annular inner body, each suspension element including a first end connected to a first position on the first inner annular body and a second end connected to a second position on the annular outer body, wherein each first position is angularly circumferentially offset from each second position; and each suspension element is configured to substantially rigidly locate a position of the annular outer body relative to the first annular inner body in axial and lateral directions while permitting controlled deflection in a radial direction, wherein the first position of each suspension element is angularly circumferentially offset to provide an imbalanced suspension capable of addressing an imbalanced loading, wherein each suspension element has an at least partially tear-shaped cross-section, and wherein each of the second annular passage, the third annular passage, and the fourth annular passage includes a plurality of outlets formed through the annular outer body, adjacent the end, each of the plurality of outlets for each of the second annular passage, the third annular passage, and the fourth annular passage delivering a gas or fuel adjacent the end of the annular outer body.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

As an initial matter, in order to clearly describe the current disclosure it will become necessary to select certain terminology when referring to and describing relevant machine components within an object, illustrated as a fuel nozzle herein. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the fuel. The term "downstream" corresponds to the direction of flow of the fluid, and the term "upstream" refers to the direction opposite to the flow. The terms "forward" and "aft," without any further specificity, refer to directions, with "forward" referring to the front or fluid receiving end of the fuel nozzle, and "aft" referring to the rearward or discharge end of the fuel nozzle. It is often required to describe parts that are at differing radial positions with regard to a centerline or center axis. The term "radial" refers to movement or position perpendicular to an axis. In cases such as this, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to the centerline or axis. Finally, the term "circumferential" refers to movement or position around the centerline or axis. It will be appreciated that such terms may be applied in relation to the centerline of the fuel nozzle.

As indicated above, the disclosure provides an object including suspension elements for positioning annular bodies relative to one another, e.g., concentrically. A method for manufacturing a metallic object is also described. In one example, the object may take the form of fuel nozzle such as those used for gas turbines, and may be formed using additive manufacturing.

Figure 1:
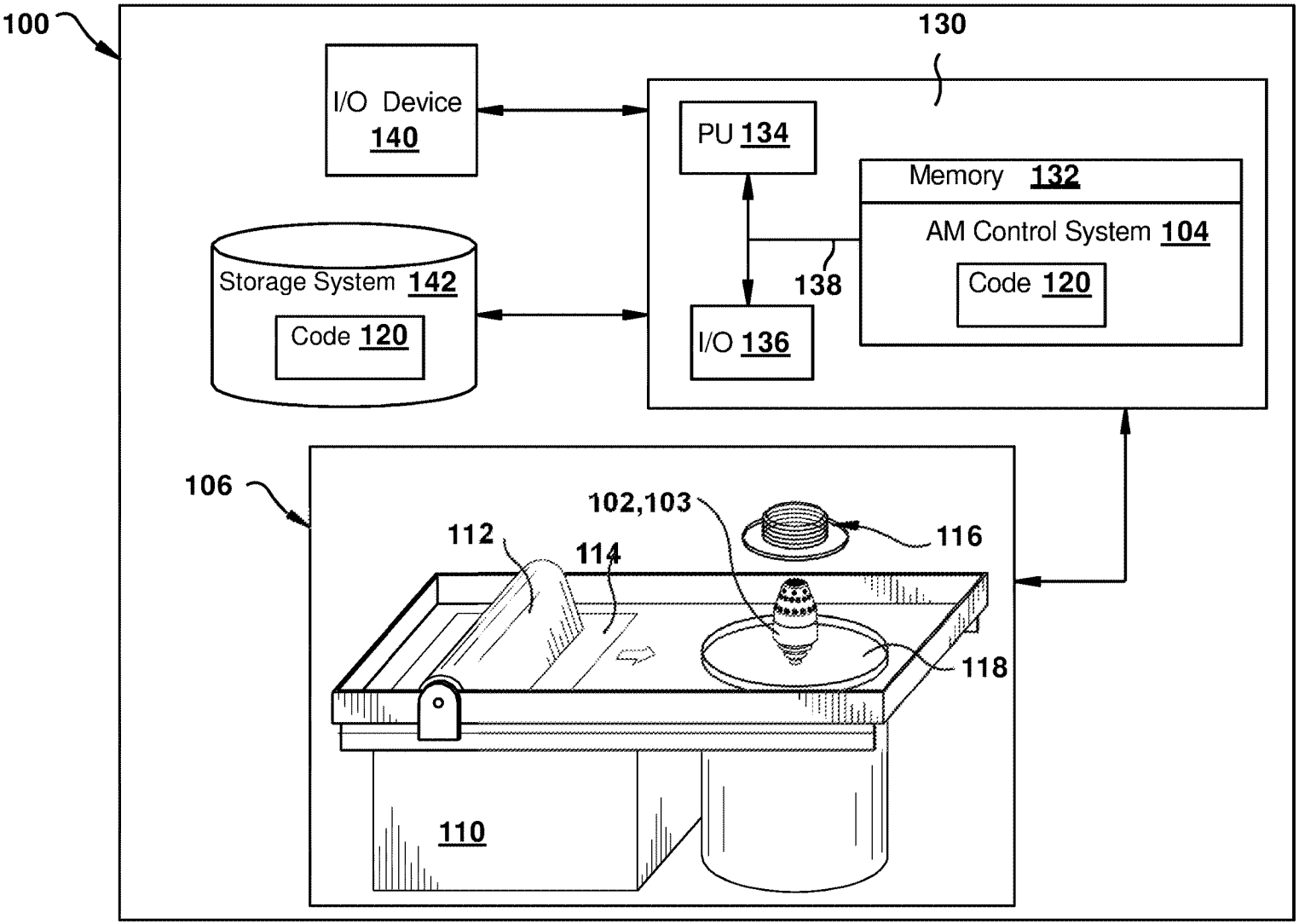
FIG. 1 shows a block diagram of an additive manufacturing process including a non-transitory computer readable storage medium storing code representative of an object according to embodiments of the disclosure.

To illustrate an example of an additive manufacturing process, FIG. 1 shows a schematic/block view of an illustrative computerized additive manufacturing (AM) system 100 for generating an object 102. In this example, system 100 is arranged for DMLM, a metal powder additive manufacturing process. It is understood that the general teachings of the disclosure are equally applicable to other forms of additive manufacturing. Object 102 is illustrated as a fuel nozzle 103 including, as will be described, a number of annular bodies 150A-D (FIG. 3); however, it is understood that the additive manufacturing process can be readily adapted to manufacture any object including spaced, annular bodies. AM system 100 generally includes a computerized AM control system 104 and an AM printer 106. AM system 100, as will be described, executes code 120 that includes a set of computer-executable instructions defining object 102 to physically generate the object using AM printer 106. Each AM process may use different raw materials in the form of, for example, fine-grain metal powder, a stock of which may be held in a chamber 110 of AM printer 106. In the instant case, object 102 may be made of metal or a metal alloy. As illustrated, an applicator 112 may create a thin layer of raw material 114 spread out as the blank canvas from which each successive slice of the final object will be created. In the example shown, a laser or electron beam 116 fuses particles for each slice, as defined by code 120. Various parts of AM printer 106 may move to accommodate the addition of each new layer, e.g., a build platform 118 may lower and/or chamber 110 and/or applicator 112 may rise after each layer.

AM control system 104 is shown implemented on computer 130 as computer program code. To this extent, computer 130 is shown including a memory 132, a processor 134, an input/output (I/O) interface 136, and a bus 138. Further, computer 130 is shown in communication with an external I/O device/resource 140 and a storage system 142. In general, processor 134 executes computer program code, such as AM control system 104, that is stored in memory 132 and/or storage system 142 under instructions from code 120 representative of object 102. While executing computer program code, processor 134 can read and/or write data to/from memory 132, storage system 142, I/O device 140 and/or AM printer 106. Bus 138 provides a communication link between each of the objects in computer 130, and I/O device 140 can comprise any device that enables a user to interact with computer 130 (e.g., keyboard, pointing device, display, etc.). Computer 130 is only representative of various possible combinations of hardware and software. For example, processor 134 may comprise a single processing unit, or be distributed across one or more processing units in one or more locations, e.g., on a client and server. Similarly, memory 132 and/or storage system 142 may reside at one or more physical locations. Memory 132 and/or storage system 142 can comprise any combination of various types of non-transitory computer readable storage medium including magnetic media, optical media, random access memory (RAM), read only memory (ROM), etc. Computer 130 can comprise any type of computing device such as a network server, a desktop computer, a laptop, a handheld device, a mobile phone, a pager, a personal data assistant, etc.

Additive manufacturing processes begin with a non-transitory computer readable storage medium (e.g., memory 132, storage system 142, etc.) storing code 120 representative of object 102. As noted, code 120 includes a set of computer-executable instructions defining object 102 that can be used to physically generate the object, upon execution of the code by system 100. For example, code 120 may include a precisely defined 3D model of object 102 and can be generated from any of a large variety of well-known computer aided design (CAD) software systems such as AutoCAD®, TurboCAD®, DesignCAD 3D Max, etc. In this regard, code 120 can take any now known or later developed file format. For example, code 120 may be in the Standard Tessellation Language (STL) which was created for stereolithography CAD programs of 3D Systems, or an additive manufacturing file (AMF), which is an American Society of Mechanical Engineers (ASME) standard that is an extensible markup-language (XML) based format designed to allow any CAD software to describe the shape and composition of any three-dimensional object to be fabricated on any AM printer. Code 120 may be translated between different formats, converted into a set of data signals and transmitted, received as a set of data signals and converted to code, stored, etc., as necessary. Code 120 may be an input to system 100 and may come from a part designer, an intellectual property (IP) provider, a design company, the operator or owner of system 100, or from other sources. In any event, AM control system 104 executes code 120, dividing object 102 into a series of thin slices that it assembles using AM printer 106 in successive layers of powder. In the DMLM example, each layer is melted or sintered to the exact geometry defined by code 120 and fused to the preceding layer. Subsequently, object 102 may be exposed to any variety of finishing processes, e.g., minor machining, sealing, polishing, assembly to another part, etc.

Figure 2:
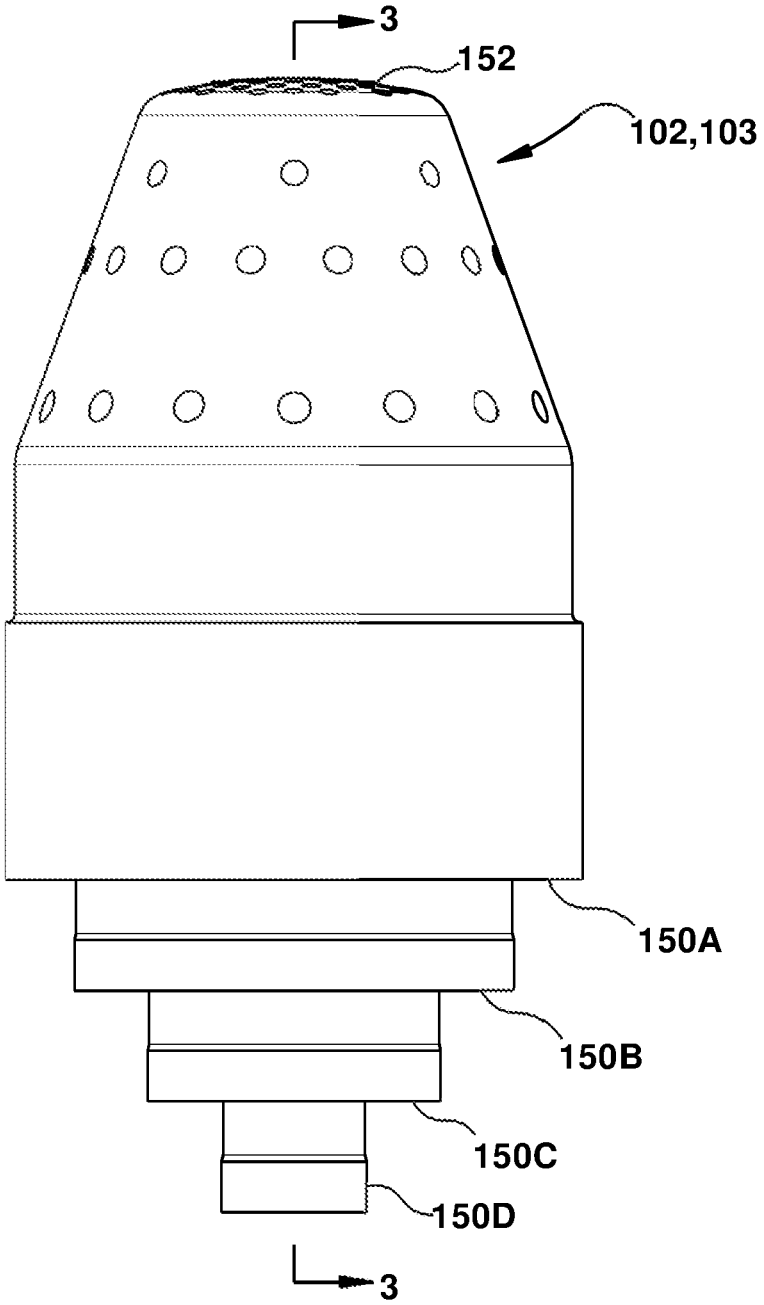
FIG. 2 shows a perspective view of an illustrative object including suspension elements, according to embodiments of the disclosure.
Figure 3:
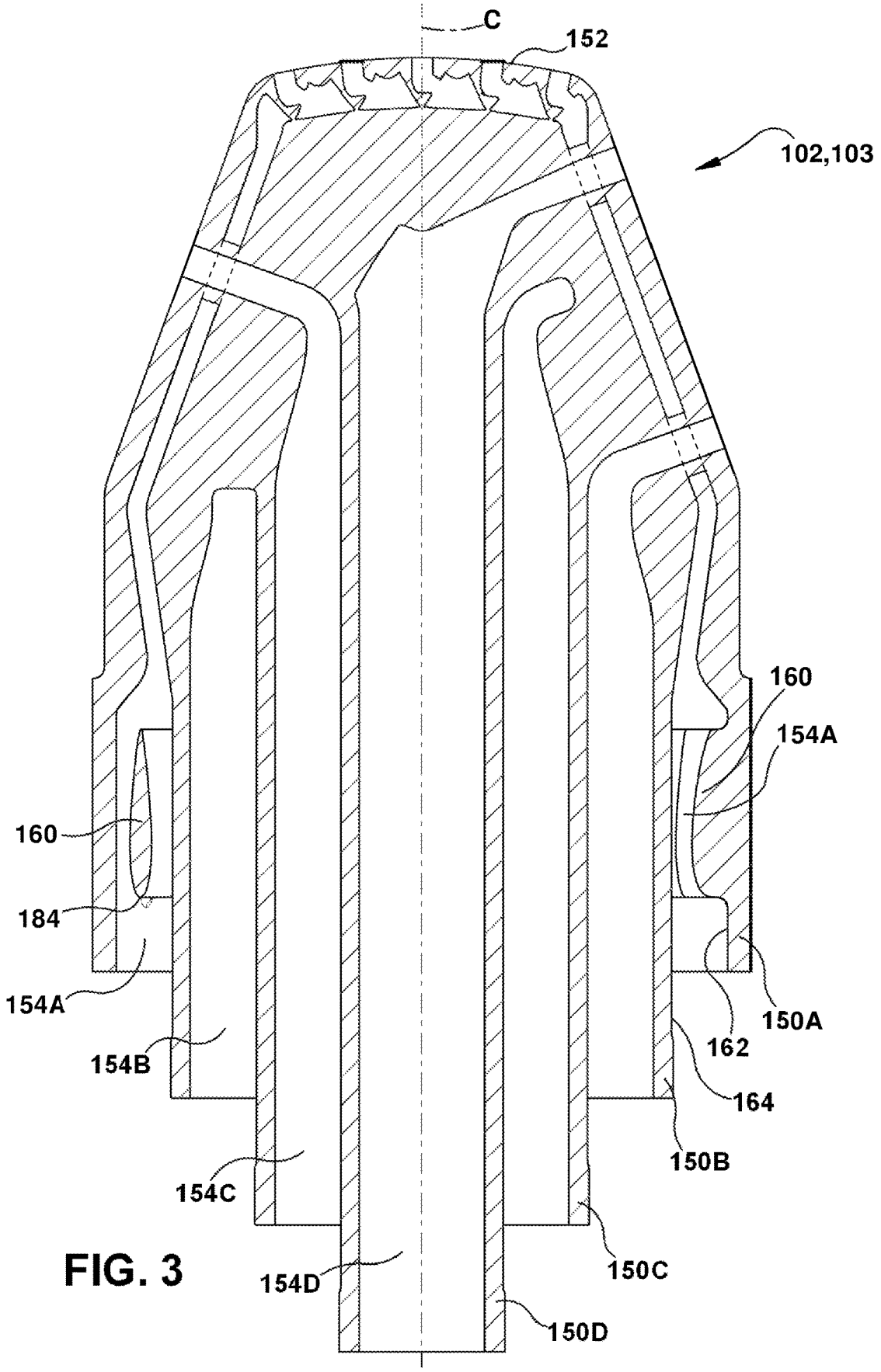
FIG. 3 shows a cross-sectional view of the illustrative object of FIG. 2 along line 3-3.

FIGS. 2-3 show object 102 including annular bodies 150A, 150B (FIG. 3) capable of employing a plurality of suspension elements 160 (FIG. 3) according to the teachings of the disclosure. FIG. 2 shows a perspective view, and FIG. 3 shows a cross-sectional view of object 102 along line 3-3 in FIG. 2. Object 102 is illustrated in the form of fuel nozzle 103. It is emphasized that object 102 in the form of fuel nozzle 103 is merely illustrative of an object including annular bodies 150 requiring a plurality of suspension elements 160, and the teachings of the disclosure can be applied to any object similarly structured. Object 102 (fuel nozzle 103) can be manufactured using additive manufacturing such as a metal power additive manufacturing system 100 (FIG. 1) or other additive manufacturing system, depending on material used.

Figure 4:
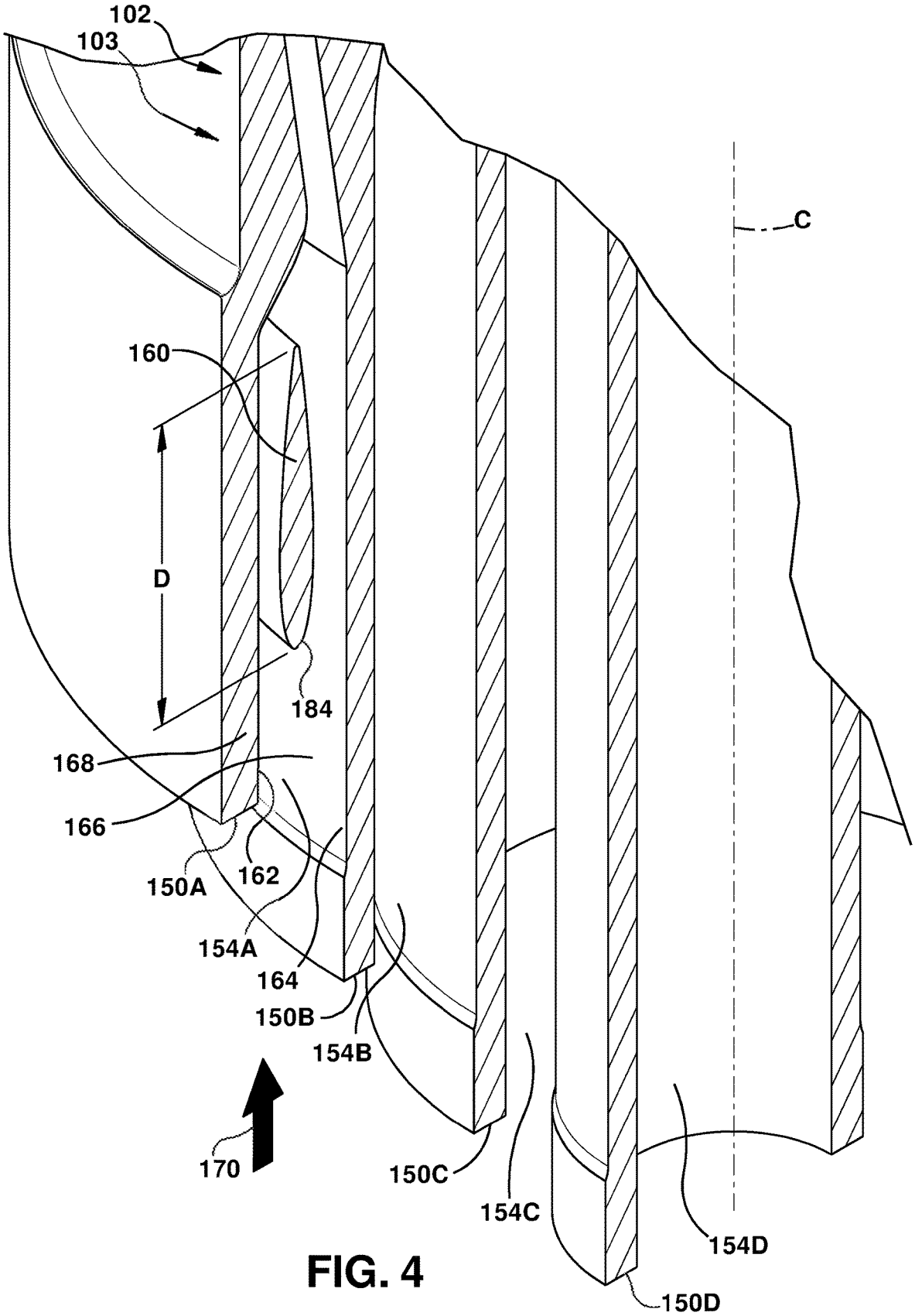
FIG. 4 shows an enlarged cross-sectional view of the object of FIG. 3.
Figure 5:
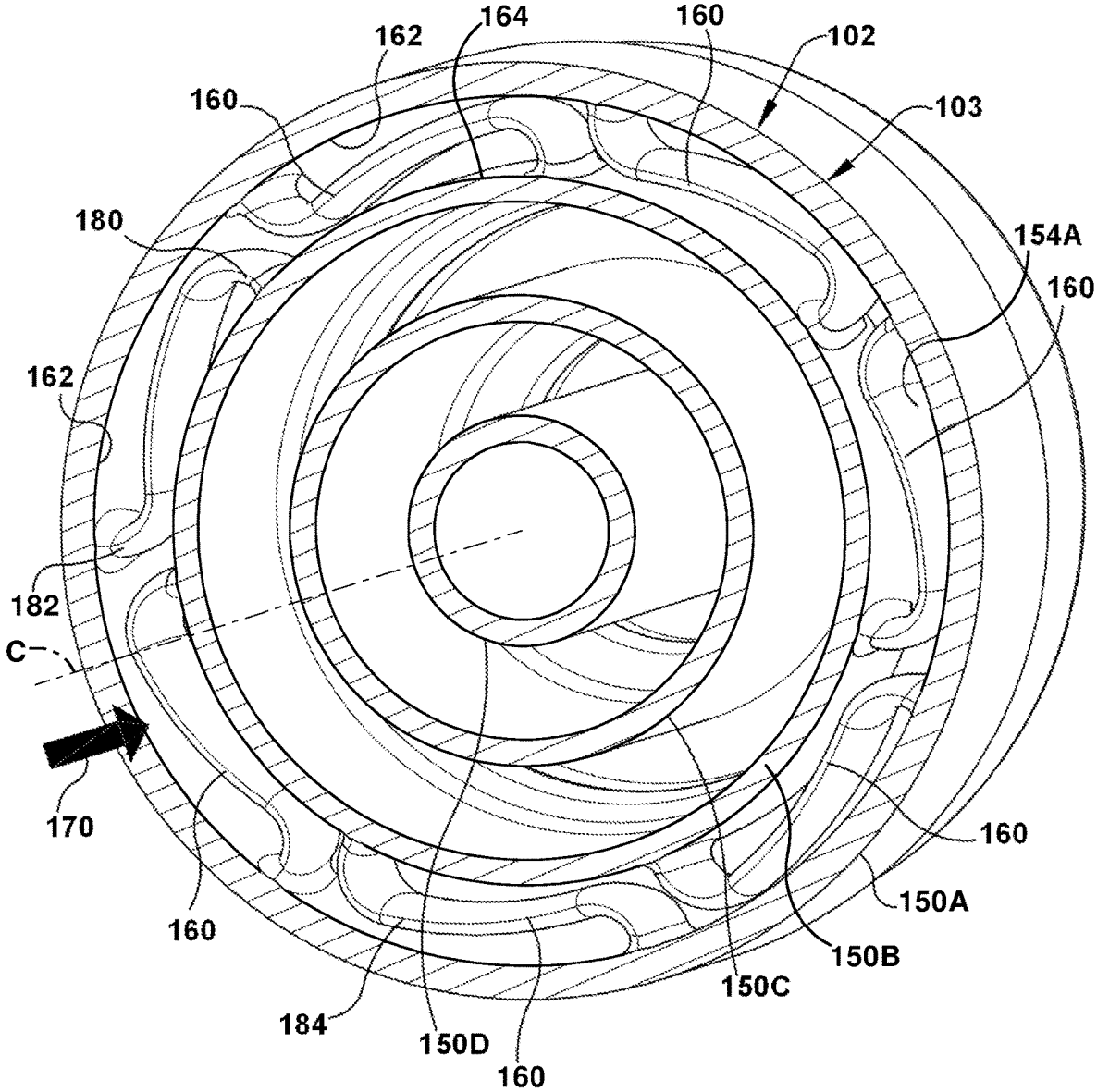
FIG. 5 shows a perspective view of an end of an object including suspension elements, in accordance with embodiments of the disclosure.
Figure 6:
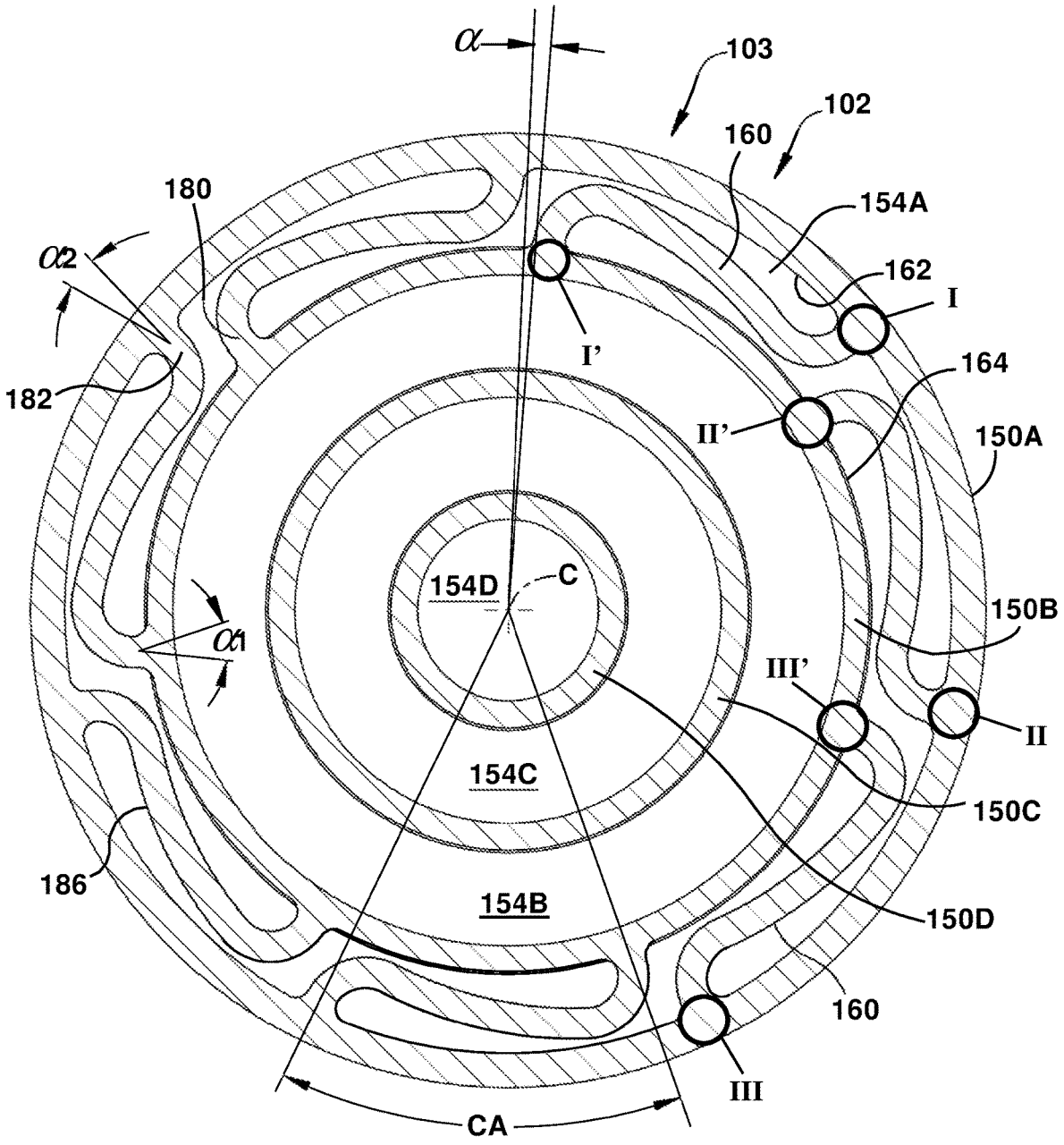
FIG. 6 shows an end view of an object including suspension elements, in accordance with embodiments of the disclosure.
Figure 8:
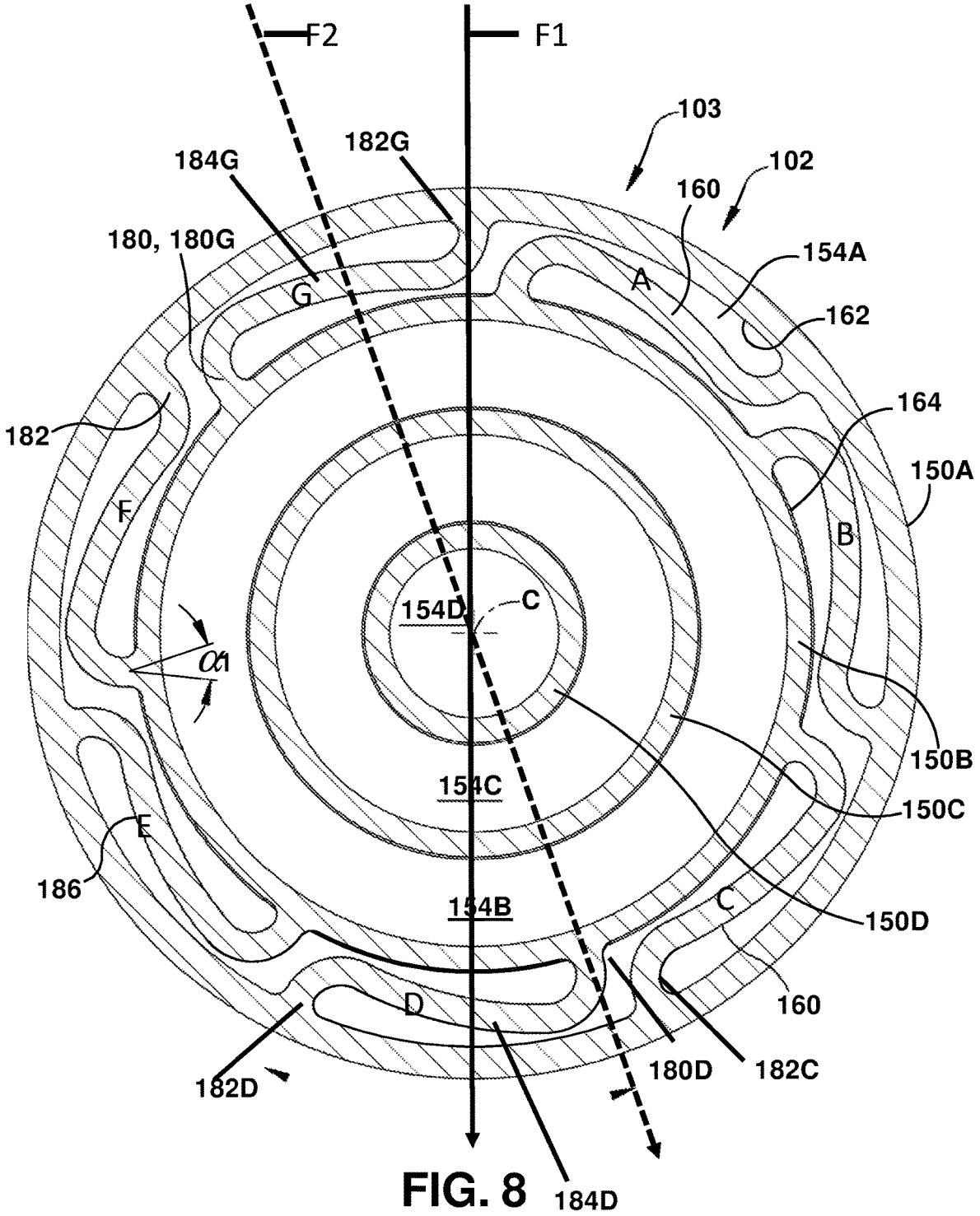
FIG. 8 shows force vectors at an end view of an object including suspension elements, in accordance with embodiments of the disclosure.

With reference to FIGS. 3-6, details of embodiments of object 102 will be described. FIG. 4 shows an enlarged cross-sectional view, FIG. 5 shows a perspective view and FIGS. 6 and 8 illustrate an end views of object 102 (FIGS. 5 and 6 from a proximal end of fuel nozzle 103). Object 102 may include an annular outer body 150A having an interior surface 162, and an annular inner body 150B disposed inside annular outer body 150A. Inner body 150B has an exterior surface 164 defining an annular passage 154A with interior surface 162 of annular outer body 150A. Where object 102 is a fuel nozzle 103, it may also include additional annular bodies 150C, D (4 total shown, 150A-D) that extend to deliver their respective fluids, e.g., air or fuel, to or near an end 152 (FIG. 2) of fuel nozzle 103. Generally, each annular body 150B-D, including annular outer body 150A, extends parallel to a centerline axis C, i.e., with some variations. Annular bodies 150B-D create concentric or near concentric annular passages 154B-D for fuel and air. In the example shown, annular inner body 150B may include an outer, combustible fuel carrying element 166 (FIG. 4) of fuel nozzle 103, i.e., an outer element of the parts of fuel nozzle 103 that carry fuel or air for combustion outside of fuel nozzle 103. Here, annular outer body 150A may take the form of a heat shield 168 for the rest of fuel nozzle 103. In this setting, a space between interior surface 162 of annular outer body 150A and exterior surface 164 of annular inner body 150B provides an annular passage 154A for carrying a coolant 170, e.g., air, to cool fuel nozzle 103. Coolant 170 may not be used in the combustion process occurring near end 152 (FIG. 2).

In accordance with embodiment of the disclosure, a plurality of suspension elements 160 connect interior surface 162 of annular outer body 150A to exterior surface 164 of annular inner body 150B. Each suspension element 160 is configured to substantially rigidly locate a position of annular outer body 150A relative to annular inner body 150B in axial (along centerline C) and lateral (circumferentially about centerline C) directions while permitting controlled deflection in a radial direction (perpendicular to centerline C). To this end, as shown in FIGS. 5 and 6, each suspension element 160 may include a first end 180 coupled to annular inner body 150B (at contact points I', II", III', etc.) and a circumferentially spaced, second end 182 coupled to annular outer body 150A (at contact points I, II, III, etc.). As shown in FIG. 4, each suspension element 160 extends a distance D parallel to centerline axis C to create a structure capable of resisting axial and lateral movement. Further, as shown in FIGS. 5 and 6, first end 180 may couple to annular inner body 150B at a first angle $\alpha$1 between 85° and 95° (e.g., 90°), and second end 182 couples to annular outer body 150A at a second angle $\alpha$2 between 85° and 95° (e.g.,) 90°. In this fashion, each suspension element 160 may have an S-shape viewed in the direction of the centerline axis C (see FIG. 6). Any number of suspension elements 160 deemed necessary to provide the desired, limited movement may be employed. In FIGS. 5 and 6, seven (7) elements 160 are employed.

In embodiments of the disclosure, suspension elements 160 may be circumferentially spaced within annular passage 154A. That is, plurality of suspension elements 160 may be circumferentially spaced between interior surface 162 of annular outer body 150A and exterior surface 164 of annular inner body 150B. In this fashion, suspension elements 160 provide even absorption of stresses. It is understood that elements 160 may be unevenly spaced, e.g., if other mounting structure couples to annular outer body 150A, to provide an imbalanced suspension capable of addressing an imbalanced loading. In other words, a distance between I and II (FIG. 6) is different from a distance between II and III. Also, as embodied by the disclosure, the distance between I' and II' is different than the distance between II' and III'.

With reference to FIG. 8, the uneven spacing of elements 160 and the imbalanced suspension addressing imbalanced loading will be described. In FIG. 8, the uneven spacing includes an odd number of elements 160, A-G. Each element 160 includes respective first ends 180X, second ends 182X, and mid sections 184X, where "X" is one of A-G of elements 160. Whereas elements 160 are configured in an odd number, first ends 180X are offset from both of first ends 180X and second ends 182X of the elements circumferentially opposite each other. Moreover, with reference to FIG. 8, midsections 184X are positions across from first ends 180X and second ends 182X. While FIG. 8 illustrates 7 elements 160, this configuration and number is merely exemplary of the odd number of elements 160 that are within the scope of the embodiments. For example, and in no manner limiting of the embodiments, the number of elements 160 may include 3, 5, 7, 9, 11, 13, and so forth.

To further clarify the imbalanced suspension addressing imbalanced loading, FIG. 8 illustrates two vectors F1 and F2, each representing a force vector against outer body 150A. Each force vector F1 and F2 are directed through centerline C. Force vector F1 loads a force on outer body 150A approximately at end 182G of element 160 G while end 180G and end 180A will also undergo some loading, but given the mechanics of statics, a majority of force vector F1 will be loaded at end 182G. The force vector F1 load is transitioned to midsection 184D that is "directly" in line with force vector F1, as seen in FIG. 8, and some load will be transitioned to ends 180 D and end 182 D. Accordingly, element 160 D will be loaded the most from force vector F1, including at midsection 184D, ends 180 D, and end 182 D, in addition to loading at element 160 G, there will be significantly lessened loading at the remainder of elements 160 B, 160 C, 160 E, and 160F.

With respect to force vector F2 (dotted lines in FIG. 8), force vector F2 is directed at outer body 150A at midpoint 184G of element 160 G, and is directed through centerline C towards the other side of outer body 150A proximate ends 180D and 182C of elements 160 D and C respectively. The force vector F2 load is initially transitioned to midsection 184G that is "directly" in line with force vector F2, as seen in FIG. 8. As the force vector F2 transitions through object 102 and some load will be transitioned to ends 180 D and end 182 C. Also, there will be some be significantly lessened loading at the remainder of elements 160 A, 160 B, 160 E, and 160F.

In one embodiment, first end 180 of each respective suspension element 160 may be within 5° (angle $\alpha$) of a circumferentially spaced, second end 182 of an adjacent suspension element 162 as measured relative to centerline C. Angle $\alpha$ is indicative of the angular distance between contact points I', II", III', etc. on annular inner body 150B and contact points I, II, III, etc. on annular outer body 150A as illustrated in FIG. 6. The circumferential arc (CA) (FIG. 6), i.e., the amount each element 160 extends arcuately about centerline C, may vary depending on the number of elements 160 employed and the desired spacing, if any, between adjacent ends 180, 182 of adjacent suspension elements 160.

Figure 7:
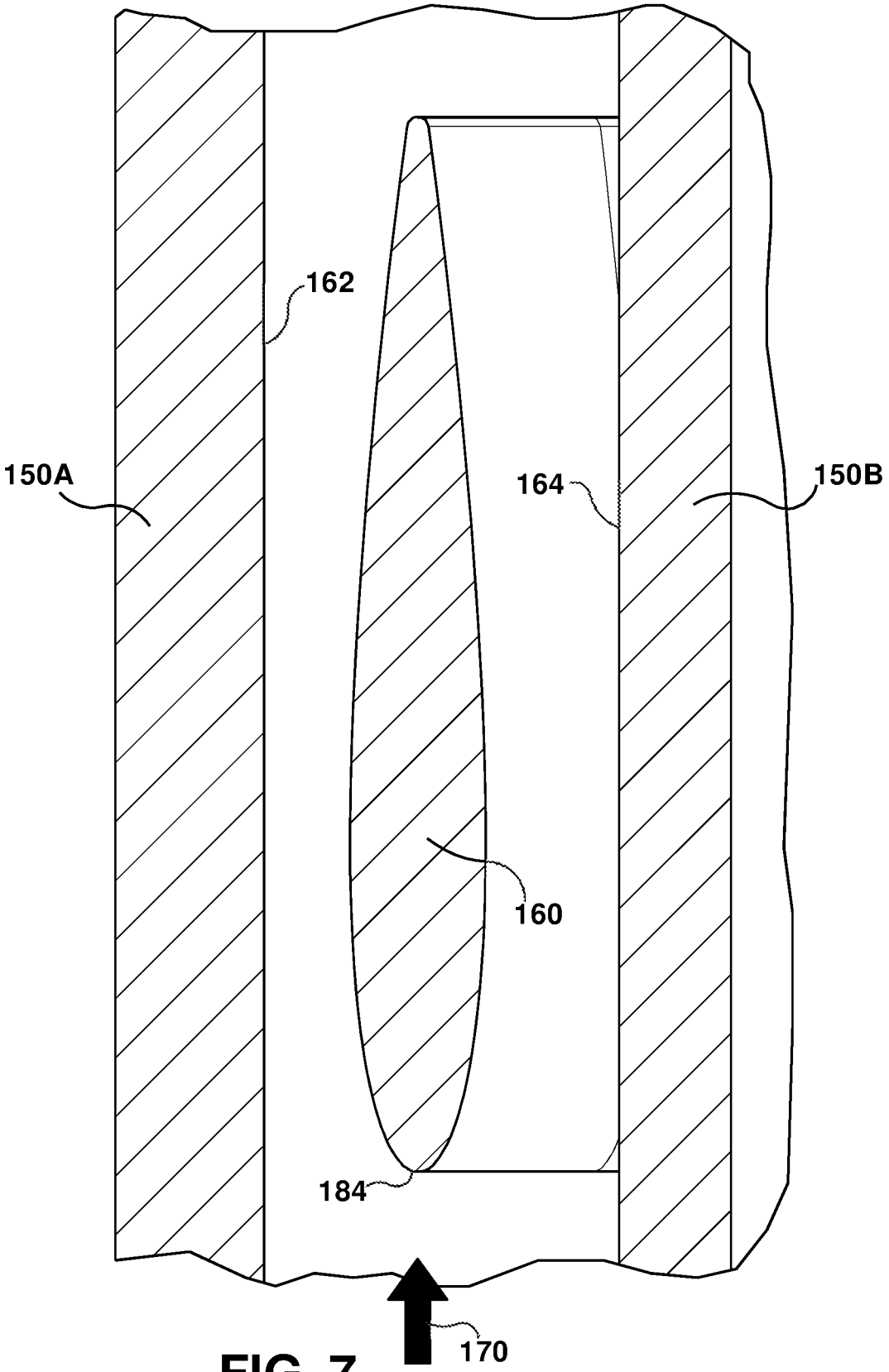
FIG. 7 shows a cross-sectional view of one illustrative suspension element including an at least partially airfoil cross-section, according to embodiments of the disclosure.

In order to reduce a pressure drop of coolant 170 within annular passage 154A, as shown best in FIGS. 3, 4 and 5, each suspension element 160 has an at least partially tear-shaped cross-section. In one embodiment, the tear-shape may be airfoil-shaped. As shown in a cross-section of a suspension element 160 in FIG. 7, the at least partially airfoil-shape can take the form of any desired airfoil such as but not limited to those promulgated by the National Advisory Committee for Aeronautics (NACA). The tear-shaped cross-section may include a leading edge 184 facing a direction of flow of coolant 170 (See FIG. 4).

A fuel nozzle 103 in accordance with embodiments of the disclosure may include annular outer heat shield 150A having interior surface 162. Annular inner body 150B may be disposed inside outer heat shield 150A. Inner body 150B has an interior 154B for delivering a combustion material, e.g., fuel and/or air, and exterior surface 164 defining an annular passage 154A with interior surface 162 of outer heat shield 150A. Plurality of suspension elements 160 connect interior surface 162 of outer heat shield 150A to exterior surface 164 of inner body 150B. Each suspension element 160 is configured to substantially rigidly locate a position of outer heat shield 150A relative to inner body 150B in axial and lateral directions while permitting controlled deflection in a radial direction. As noted, each suspension element 160 may include an at least partially tear-shaped cross-section.

As noted, object 102 and fuel nozzle 103 may be formed using the AM processes described herein, providing a one-piece construction that is tolerant to thermally induced radial growth and relatively large axial forces, but also provides a low pressure drop for coolant. The teachings of the disclosure are applicable to any situation in which annular bodies need to be positioned within one another, and limited movement caused by, for example, thermal stress, is required.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. An object, comprising:

an annular outer body having an end and an interior surface;

a first annular inner body disposed inside the annular outer body, the first annular inner body having an exterior surface defining a first annular passage with the interior surface of the annular outer body, wherein the first annular passage includes a first plurality of outlets formed on the end of the annular outer body, the first annular passage receiving a coolant and discharging the coolant adjacent the end of the annular outer body;

a second annular inner body disposed inside the first annular inner body, the second annular inner body defining a second annular passage with the first annular inner body;

a third annular inner body disposed inside the second annular inner body, the third annular inner body defining:

a third annular passage with the second annular inner body; and a fourth annular passage opposite and surrounded by the third annular passage; and a plurality of suspension elements connecting the interior surface of the annular outer body to the exterior surface of the first annular inner body, each suspension element including:

a first end connected to a first position on the first inner annular body, wherein a distance from the first position of a first suspension element to the first position of an adjacent second suspension element is different from that of the first position of the adjacent second suspension element to the first position of an adjacent third suspension element;

and a circumferentially spaced, second end connected to a second position on the annular outer body wherein a distance from the second position of the first suspension element to the second position of the adjacent second suspension element is different from that of the second position of the adjacent second suspension element to the second position of the adjacent third suspension element;

wherein each first position is angularly circumferentially offset from each second position to provide an imbalanced suspension capable of addressing an imbalanced loading; and each suspension element is configured to substantially rigidly locate a position of the annular outer body relative to the first annular inner body in axial and lateral directions while permitting controlled deflection in a radial direction, wherein each suspension element has an at least partially tear-shaped cross-section, and wherein each of the second annular passage, the third annular passage, and the fourth annular passage includes a plurality of outlets formed through the annular outer body, adjacent the end, each of the plurality of outlets for each of the second annular passage, the third annular passage, and the fourth annular passage delivering a gas or fuel adjacent the end of the annular outer body.

2. The object of claim 1, wherein the first end couples to the first annular inner body at a first angle between 85° and 95°, and the circumferentially spaced, second end couples to the annular outer body at a second angle between 85° and 95°.

3. The object of claim 1, wherein the annular outer body extends parallel to a centerline axis and each suspension element has an S-shape viewed in the direction of the centerline axis.

4. The object of claim 3, wherein each suspension element extends a distance parallel to the centerline axis.

5. The object of claim 3, wherein the first end of each respective suspension element is within 5° of the circumferentially spaced, second end of an adjacent suspension element as measured relative to the centerline axis.

6. The object of claim 1, wherein the plurality of suspension elements are circumferentially spaced between the interior surface of the annular outer body and the exterior surface of the first annular inner body.

7. The object of claim 1, wherein the first annular inner body includes an outer, combustible fuel carrying element of a fuel nozzle, and the annular outer body includes a heat shield for the fuel nozzle, and wherein a space between the interior surface of the annular outer body and the exterior surface of the first annular inner body carries the coolant therethrough.

8. A fuel nozzle, comprising:

an annular outer heat shield having an end and an interior surface;

a first annular inner body disposed inside the annular outer heat shield, the first annular inner body having an interior for delivering a combustion material and an exterior surface defining a first annular passage with the interior surface of the outer heat shield, wherein the first annular passage includes a first plurality of outlets formed on the end of the annular outer heat shield, the first annular passage receiving a coolant and discharging the coolant adjacent the end of the annular outer heat shield;

a second annular inner body disposed inside the first annular inner body, the second annular inner body defining a second annular passage with the first annular inner body;

a third annular inner body disposed inside the second annular inner body, the third annular inner body defining:

a third annular passage with the second annular inner body; and a fourth annular passage opposite and surrounded by the third annular passage; and a plurality of suspension elements connecting the interior surface of the annular outer heat shield to the exterior surface of the first annular inner body, each suspension element including:

a first end connected to a first position on the first inner annular body, wherein a distance from the first position of a first suspension element to the first position of an adjacent second suspension element is different from that of the first position of the adjacent second suspension element to the first position of an adjacent third suspension element;

and a circumferentially spaced, second end connected to a second position on the annular outer heat shield, wherein a distance from the second position of the first suspension element to the second position of the adjacent second suspension element is different from that of the second position of the adjacent second suspension element to the second position of the adjacent third suspension element;

wherein each first position is angularly circumferentially offset from each second position to provide an imbalanced suspension capable of addressing an imbalanced loading; and each suspension element is configured to substantially rigidly locate a position of the annular outer heat shield relative to the first annular inner body in axial and lateral directions while permitting controlled deflection in a radial direction;

wherein each suspension element has an at least partially tear-shaped cross-section, and wherein each of the second annular passage, the third annular passage, and the fourth annular passage includes a plurality of outlets formed through the annular outer heat shield, adjacent the end, each of the plurality of outlets for each of the second annular passage, the third annular passage, and the fourth annular passage delivering a gas or fuel adjacent the end of the annular outer heat shield.

9. The fuel nozzle of claim 8, wherein the first end couples to the first annular inner body at a first angle between 85° and 95°, and the circumferentially spaced, second end couples to the annular outer heat shield at a second angle between 85° and 95°.

10. The fuel nozzle of claim 8, wherein the annular outer heat shield extends parallel to a centerline axis and each suspension element has an S-shape viewed in the direction of the centerline axis.

11. The fuel nozzle of claim 10, wherein each suspension element extends a distance parallel to the centerline axis.

12. The fuel nozzle of claim 11, wherein the first end of each respective suspension element is within 5° of the circumferentially spaced, second end of an adjacent suspension element measured relative to the centerline.

13. The fuel nozzle of claim 8, wherein the plurality of suspension elements are circumferentially spaced between the interior surface of the annular outer heat shield and the exterior surface of the first annular inner body.

14. The fuel nozzle of claim 8, wherein a space between the interior surface of the annular outer heat shield and the exterior surface of the first annular inner body carries the coolant therethrough.

15. The fuel nozzle of claim 14, wherein the at least partially tear-shaped cross-section includes a leading edge facing a direction of flow of the coolant.

16. A non-transitory computer readable storage medium storing code representative of an object, the object physically generated upon execution of the code by a computerized additive manufacturing system, the code comprising:

code representing the object, the object including:

an annular outer body having an end and an interior surface;

a first annular inner body disposed inside the annular outer body, the first annular inner body having an exterior surface defining a first annular passage with the interior surface of the annular outer body, wherein the first annular passage includes a first plurality of outlets formed on the end of the annular outer body, the first annular passage receiving a coolant and discharging the coolant adjacent the end of the annular outer body;

a second annular inner body disposed inside the first annular inner body, the second annular inner body defining a second annular passage with the first annular inner body;

a third annular inner body disposed inside the second annular inner body, the third annular inner body defining:

a third annular passage with the second annular inner body; and a fourth annular passage opposite and surrounded by the third annular passage; and a plurality of suspension elements connecting the interior surface of the annular outer body to the exterior surface of the first annular inner body, each suspension element including:

a first end connected to a first position on the first inner annular body, wherein a distance from the first position of a first suspension element to the first position of an adjacent second suspension element is different from that of the first position of the adjacent second suspension element to the first position of an adjacent third suspension element;

and a circumferentially spaced, second end connected to a second position on the annular outer body wherein a distance from the second position of the first suspension element to the second position of the adjacent second suspension element is different from that of the second position of the adjacent second suspension element to the second position of the adjacent third suspension element;

wherein each first position is angularly circumferentially offset from each second position to provide an imbalanced suspension capable of addressing an imbalanced loading; and each suspension element is configured to substantially rigidly locate a position of the annular outer body relative to the first annular inner body in axial and lateral directions while permitting controlled deflection in a radial direction, wherein each suspension element has an at least partially tear-shaped cross-section, and wherein each of the second annular passage, the third annular passage, and the fourth annular passage includes a plurality of outlets formed through the annular outer body, adjacent the end, each of the plurality of outlets for each of the second annular passage, the third annular passage, and the fourth annular passage delivering a gas or fuel adjacent with the end of the annular outer body.

17. The storage medium of claim 16, wherein each suspension element extends a distance parallel to the centerline axis.

* * * * *